US006719878B1

(12) United States Patent
Svedman

(10) Patent No.: US 6,719,878 B1
(45) Date of Patent: Apr. 13, 2004

(54) METHOD FOR AVOIDING MECHANICAL DAMAGE OF PULP

(75) Inventor: Mikael Svedman, Pori (FI)

(73) Assignee: Metso Chemical Pulping Oy (FI)

( * ) Notice: Subject to any disclaimer, the term of this patent is extended or adjusted under 35 U.S.C. 154(b) by 0 days.

(21) Appl. No.: 09/926,578

(22) PCT Filed: May 22, 2000

(86) PCT No.: PCT/FI00/00459

§ 371 (c)(1),
(2), (4) Date: Feb. 26, 2002

(87) PCT Pub. No.: WO00/73575

PCT Pub. Date: Dec. 7, 2000

(30) Foreign Application Priority Data

May 28, 1999 (FI) ..... 991220

(51) Int. Cl.[7] ..... D21C 3/26

(52) U.S. Cl. ..... 162/17; 162/52; 162/55; 162/60; 162/90; 162/246

(58) Field of Search ..... 162/17, 52, 55, 162/60, 90, 246

(56) References Cited

U.S. PATENT DOCUMENTS 4,814,042 A 3/1989 MacLeod et al.
4,975,148 A 12/1990 Ryham

FOREIGN PATENT DOCUMENTS

WO WO-97/15715 A1 5/1997

OTHER PUBLICATIONS

Rydholm, Sven A., Pulping Processes, Interscience Publishers, 1965, pp. 583–589.*

M.E. Cyr, et al., "Stronger kraft softwood pulp—achieved!", Tappi Journal, Oct. 1989, pp. 157–163.

Casey, James P. (Editor), Pulp and Paper Chemistry and Chemical Technology, Third Edition, vol. 1, pp. 443–448.

* cited by examiner

*Primary Examiner*—Steven P. Griffin
*Assistant Examiner*—Mark Halpern
(74) *Attorney, Agent, or Firm*—Lerner, David, Littenberg, Krumholz & Mentlik, LLP

(57) ABSTRACT

A method for producing chemical pulp from cellulosic material by means of alkaline cooking, including cooking the material to pulp at cooking temperature in a digester, reducing the temperature at the end of the cook, substantially relieving the overpressure in the digester and then discharging the pulp from the digester by means of pumping. The method is characterized in that the pulp is cooled to essentially 85° C. to 70° C. before pumping cooked material as a fluid suspension from the digester, and that the temperature of the cooked material is maintained in the same temperature range and at a pH level being between 10 and 13, between the digester and a first delignification/bleaching stage, thus avoiding mechanical damage of cellulosic material.

14 Claims, 6 Drawing Sheets

METHOD FOR AVOIDING MECHANICAL DAMAGE OF PULP

FIELD OF THE INVENTION

The invention relates to alkaline pulping, and particularly to the process stages following an alkaline cooking stage and prior to further delignification stages.

BACKGROUND OF THE INVENTION

Alkaline pulping processes and especially kraft pulping are dominant in the production of cellulose, because alkaline pulping provides pulp fibers which are stronger than those from any other commercial pulping process. However, in industrial alkaline pulping processes fiber damage occurs. It has been found that laboratory pulp produced from the same chip lot normally shows superior strength compared to the commercial alkaline pulp. The present invention relates to an improved method for treating delignified lignocellulosic material after delignification in alkaline cooking liquor and cooling of the cooked material. The invention relates to a method whereby improved strength properties of cooked material are achieved compared to material that has been treated under normal industrial conditions after the end of alkaline cooking and cooling of the cooked material.

In the alkaline cooking processes, the lignocellulosic material reacts with alkaline cooking liquors for a certain time at a specified temperature. The cooking liquor can be kraft liquor, soda, alkaline sulfite, polysulfide, alkaline solvent or other modifications, e.g. including added anthraquinone. At the end of a cook, a specified degree of delignification being achieved, the cooking material is at high temperature and pressure inside a digester. This is true in both continuous and batch cooking processes.

The cooked material can then be cooled using cooler spent liquors to replace the hot spent liquor surrounding the delignified material inside the digester. This routinely occurs in the counter-current washing zone in many continuous digesters, but is less common in conventional batch digesters. With or without precooling, the delignified cellulosic material can be removed from the digester under pressure using a pipe to a receiving tank essentially at atmospheric pressure. Because of this, the cooked material experiences a large pressure and/or temperature drop in an highly alkaline environment via a series of transport and depressurising devices during its transfer from the digester to the receiving vessel. The outcome of this mechanical action during blow is usually inferior pulp and fiber strength compared to the strength potential of the lignocellulosic material. This was found, for example, by retrieving samples from baskets placed inside industrial conventional batch digesters. Reference pulp was thus obtained which had not experienced the vigorous treatment involved with blowing. This pulp showed a strength comparable to that of pulp from pilot digesters. Thus, it was concluded that the strength deficit occurred in the digester blow.

In the 1980's, liquor displacement procedures in batch digesters were developed. This technology was driven by energy considerations, and also provided improved strength delivery of the delignified cellulosic material over cooking and the possibility to extend delignification by cooking. Thus, less fiber damage was induced in cooking and digester discharge. This was achieved by (1) modified cooking chemistry, (2) a uniform chemical and temperature profile in the digester, and (3) gentle discharge of the digester. Examples of gentle discharge techniques used in liquor displacement batch cooking are "cold blow" and pump discharge. In U.S. Pat. No. 4,814,042, a method to gently remove delignified cellulosic material from a digester at the end of an alkaline cook is described. The cooked material is cooled to below 100° C., and the overpressure in the digester is essentially released to or near atmospheric pressure. The cellulosic material is then transferred as a fluid suspension to a receiving tank using a pump. Pumping is carried out at a controlled flow rate to reduce physical fiber damage compared to conventional discharge of digesters, resulting in improved strength properties in the pulp. The pump discharge technique is today routinely used in liquor displacement batch digesters at temperatures below 100° C. to avoid large pressure differences between digester and receiving vessel, boiling of liquors in the pipe from the digester to the receiving vessel, boiling in the receiving vessel, cavitation in pumps etc. The reason for using temperatures below 100° C. or close to 100° C. is that it makes it possible to use atmospheric receiving tanks, which are less expensive than pressure vessels. This technique allows a low pressure difference between the digester and the receiving tank, which is advantageous for pulp strength. Another reason is that boiling at atmospheric pressure is avoided if temperatures below the boiling point of the liquor (below 100° C.) are used. This lowers the amount of released odour gases. For these reasons, the discharge temperatures used for modern industrial liquor displacement batch digester fiberlines are typically 90 to 100° C. Lower temperatures has so-far not been seen required. In continuous digesters, the discharge temperature is normally between 80 and 100° C. when the digester is followed by a receiving tank or atmospheric diffusion washer. The temperature can be 80 to 120° C. if the digester is followed by a receiving tank or a pressure diffusion washer. The optimal discharge temperature in continuous digesting followed by a diffusion washer is a consequence of the vigorous discharge from the continuous digester as the cooked material experience a large immediate pressure drop which creates e.g. foam, flashing and thereby determines the maximal operating temperature of the first washing equipment after the digester. The vigorous discharge and treatment in continuous digesting will also damage the fiber. Thus, high quality pulp is not produced in continuous cooking.

Another route of development has been to increase the temperature in washing of the cooked defiberised material. In washing, increased temperature improves drainability of water through the pulp mat and enhances leaching of dissolved material to the surrounding liquor. Conventional vacuum washers, being the most widely used equipment for brown-stock washing and in bleach plants, are being replaced by such new, more efficient washing equipment as pressure washers, drum displacement (DD) washers, wash presses and diffusion washers. Vacuum washers cannot normally be operated at temperatures above 85° C. However, the new washing equipment mentioned above can be operated at temperatures above 85° C. Thus, the latest development in washing technology enables use of higher temperatures and improved washing efficiency. The equipment involved essentially operates at atmospheric or higher pressure. Thus, vacuum is not used to generate a pressure difference over the pulp mat. The new washing technology also shows more efficient washing at the same temperature.

We have found that the pulp sampled from the inlet to the receiving tank when pump digester discharge is used at temperatures below 100° C., which typically means between 100 and 90° C., using an essentially depressurised digester, shows a strength delivery which is typically close to 100%.

However, we have also found that this strength is typically not retained after further brownstock treatment, although the method described in above cited U.S. Pat. No. 4,814,042 and Tappi J., October 1987, p. 157–163 is used.

Thus, although a kraft digester is discharged gently, at a low flow velocity, the conditions in the process stages following discharge should also be taken into account to produce maximum pulp strength.

In normal practice according to the prior art, the cooked cellulosic material experiences a series of mechanical processing stages in depressurising devices, valves, agitators, separation devices and pumps before bleaching and delignifying with, e.g. oxygen, chlorine or chlorine dioxide-containing chemicals. We have found that significant strength losses can occur during hot treatment stages of the delignified cellulosic material following digester discharge, i.e. storage in the receiving tank at 90 to 100° C., knotting, screening and washing.

After batch cooking and discharge, the pulp slurry is usually stored in a receiving tank at the resulting temperatures which is typically 90 to 100° C., and subsequent treatment of the delignified cellulosic material occurs essentially at a pH above 10. This is evident by measurement of pH in the liquor surrounding the pulp at various points between alkaline cooling and the first delignification/bleaching stage. In normal washing after alkaline cooking, the pH remains alkaline (*Pulp and Paper Chemistry and Chemical Technology*, third edition, Volume 1, James P. Casey, ed., p. 446). The temperature also remain close to the boiling point of the liquor in digester discharging. In *Tappi J*. October 1989, p. 157–161 it is shown that the digester discharge temperature is in the range 85–100° C. after a complete displacement of a batch digester with wash liquor. Typically, most of the material inside the digester is cooled to approximately 100° C. after liquor displacement with wash liquor (p. 159). The temperature can also remain close to the boiling temperature in the intermediate stages if the counter-current liquors used in washing and dilution of the cooked material are not temperature-adjusted. For example, a system applying liquor-displacement cooking, discharge of the digester at 95° C. to a storage tank, brownstock washing with pressure filters, screening and oxygen delignification at 100° C. will show a temperature of approximately 95° C. in the area between the digester and the first delignification/bleaching stage. However, we have observed that treatment of the cooked material at temperatures close to 100° C. in single or several stages induced fiber damage which is a consequence of the combination of mechanical treatment and high temperature, alkalinity, ionic strength and impurities in the liquor within and surrounding the alkaline delignified cellulosic material after alkaline cooking. In an article by Cyr et al (*Tappi J*. October 1989 p. 162), it is stated that variables such as temperature, pressure drop, geometry of the blow system and the alkalinity of the spent liquor may alter the amount of fiber damage from mill to mill. The authors, however, suggest that appropriate pulp suspension velocity in two-phase flow probably can minimize pulp strength losses in all cases.

However, as those skilled in art are aware, the alkaline pulp (brownstock) is processed further and stored after digester discharge, awaiting further delignification and/or bleaching of the impure alkaline pulp. Thus, there are numerous process stages involving mechanical treatment that can still damage the fiber. The process conditions as the combination of temperature, pH and ionic strength are also important for the pulp strength outcome.

Brownstock washing is a dominant operation between the cooking and further delignification stages. Many factors influence the operation of washers. The choice of operating temperature is important, since higher temperature reduces the liquor viscosity and thus improves liquor drainage. As stated above, the most widely used equipment is the conventional vacuum washer. In a vacuum washer, however, too high a temperature increases the vapor pressure and thus reduces the vacuum in the drop leg of a vacuum washer. In a conventional brownstock washing system with rotary vacuum washers, the temperature is maintained by using hot water at about 60–70° C. in the final stage washer (*Pulp and Paper Chemistry and Chemical Technology*, third edition, Volume 1, James P. Casey, ed., p. 448). Conventional vacuum washers are therefore being replaced by pressure washers, drum displacement (DD) washers, wash presses, atmospheric diffusion washers and pressure diffusion washers, as modern washing equipment can be operated at higher temperatures and are more efficient washers.

The reasons for maintaining high temperatures in intermediate stages according to the prior art are usually found in improved washing efficiency and capacity when e.g. a pressure filter is operated at higher temperatures. If higher temperatures are allowed, no pre-cooling of pulp or liquors is required. Another reason for using high temperatures is the increased use of oxygen delignification. Oxygen delignification is typically carried out at temperatures between 90 to 105° C., and a consequence of this is an increase in the temperature of the brownstock washing (i.e. pre-oxygen delignification washing) stage, as the filtrates produced in post-oxygen delignification washing are used in brownstock washing.

Pulp consistency typically varies between 1.5 and 35% between digester discharge and the first subsequent delignification stage.

SUMMARY OF THE INVENTION

The primary objective of the present invention is to provide a method for treating delignified cellulosic material during the process stages between the end of an alkaline cooking stage and the beginning of a stage for further delignification, thereby preventing the pulp fibers from suffering severe damage. A method according to the present invention furnishes pulp that can be used for the manufacture of paper materials which have superior strength properties relative to materials made from pulp produced according to the prior art.

DETAILED DESCRIPTION OF THE INVENTION

Figure 1:
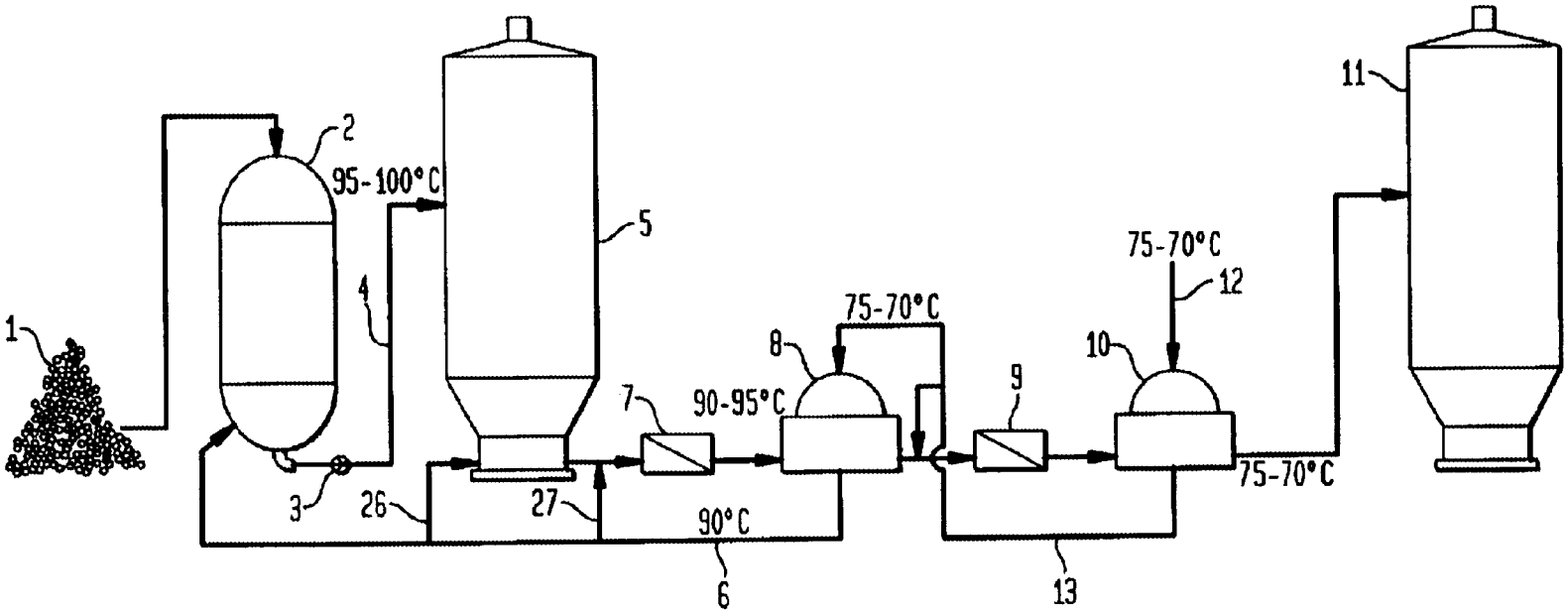
FIG. 1 (PRIOR ART)
FIG. 1 shows a typical prior art brownstock production line without an oxygen delignification step.

In accordance with the present invention, a method is provided wherein process conditions are controlled during discharge of delignified cellulosic material from a digester or receiving vessel, and during the handling of the alkaline and cation-containing cooked material before subsequent delignification and/or bleaching. The method comprises steps of cooling delignified cellulosic material to between about 60 and about 85° C. before discharging the digester, and maintaining said temperature level while the cooked cellulosic material is treated and prepared for further delignification and/or bleaching. Additionally, the method comprises minimizing pressure drops and flow velocities in the processing of the cooked material before further delignification and/or bleaching. The method comprises treatment of the cooled alkaline delignified cellulosic material in spent liquor having a low ionic strength, before further delignification and/or bleaching stages. Preferably, the pH in the liquid surrounding the pulp during the process stages between the digester and the first subsequent delignification stage is maintained below 13. In case said first delignification stage is an oxygen stage, said pH is preferably maintained between about 10 and about 13. Preferably, the ionic strength in the pulp during the process stages between the digester and the first subsequent delignification stage is maintained between about 0.01 and about 1,5 mol/l. Most preferably, the ionic strength is maintained between about 0.01 and about 1 mol/l. Preferably, if pH in the liquid surrounding the pulp remains above 11 during said stages, residence times for the process stages between digester and the first subsequent delignification/bleaching stage are less than about 180 min, more preferably less than about 120 min.

The method significantly reduces the physical damage of fibers which occurs during pulp treatment following conventional or pump discharge of digesters, thereby resulting in superior strength properties in the pulp entering subsequent process stages including bleaching with oxygen, chlorine, chlorine dioxide-containing chemicals, and corresponding bleaching and delignification stages used after cooking. A low digester discharge temperature also decreases cavitation in the discharge pump and its suction pipe. Thus, a lower discharge temperature can also be advantageous in terms of discharge time and pulp consistency variation in down-stream processes.

Lowering the temperature of the cooked material to be discharged from the digester and maintaining a low temperature during intermediate treatment before further delignification is an important factor as such for achieving improved pulp strength. Further improvement is achieved by submitting the cooked material to a minimal amount of mechanical impact. The solution is to minimize the number of pressure drops, depressurising devices, valves, agitation stages, separation devices and pumps, as well as minimizing the magnitude of mechanical impact that occurs during unavoidable transfer and separation operations of the alkaline pulp before bleaching and delignifying with e.g. oxygen, chlorine, or chlorine dioxide-containing chemicals. Mechanical separation processes, like screening, are preferably placed in conditions where the ionic strength in the surrounding liquor is low (below 0.4 mol/l). Variable speed pumps serve as an efficient tool to minimize pressure drops and mechanical impact. Further improvement is achieved by treating the pulp at low pH levels essentially without causing precipitation of dissolved material onto the fibers, and by treating the pulp at as low an ionic strength as possible. The solution is to use condensates or water in brownstock washing and digester displacement, instead of recirculated liquors from the delignification/bleaching stages. This can for example comprise evaporation or other cleaning method of spent liquors, and re-use of cleaner condensates. Another advantage of the invention is that is can easily be combined with oxygen delignification technology according to Swedish Patent application 9503720-6, (the OxyTrac method) where the first oxygen stage is accomplished at temperatures below 90° C. and the second stage at above 90° C., whereby the temperature difference between the stages is less than 20° C. OxyTrac typically uses 80–85° C. in the first tower and 90–105° C. in the second stage. Thus, in the method in accordance with the invention, the temperature is easily adjusted in the feed to the first reactor in the oxygen stage.

The invention is demonstrated more closely by means of the attached drawings and the Examples provided below. FIG. 1 shows a typical brownstock production line, comprising a digester (2) for receiving wood chips (1); a discharge line (4) with pump (3), leading to a discharge tank (5). Following the discharge tank are knotting (7) and screening (9) units, and a number of brownstock washers (8, 10) The washing stages shown in the figures are to be understood as possibly comprising several units of various types. On its way to storage tower (11), the cooked pulp is washed with a countercurrent flow starting with feed water (12), conveyed by filtrate lines (13, 6); the wash filtrate may finally be used for displacing cooking liquor from digester (1). Typical temperatures for various process 30 stages are displayed in the figure. Dilution streams may be diverged from the countercurrent wash stream into the product stream as shown (26, 27).

Figure 2:
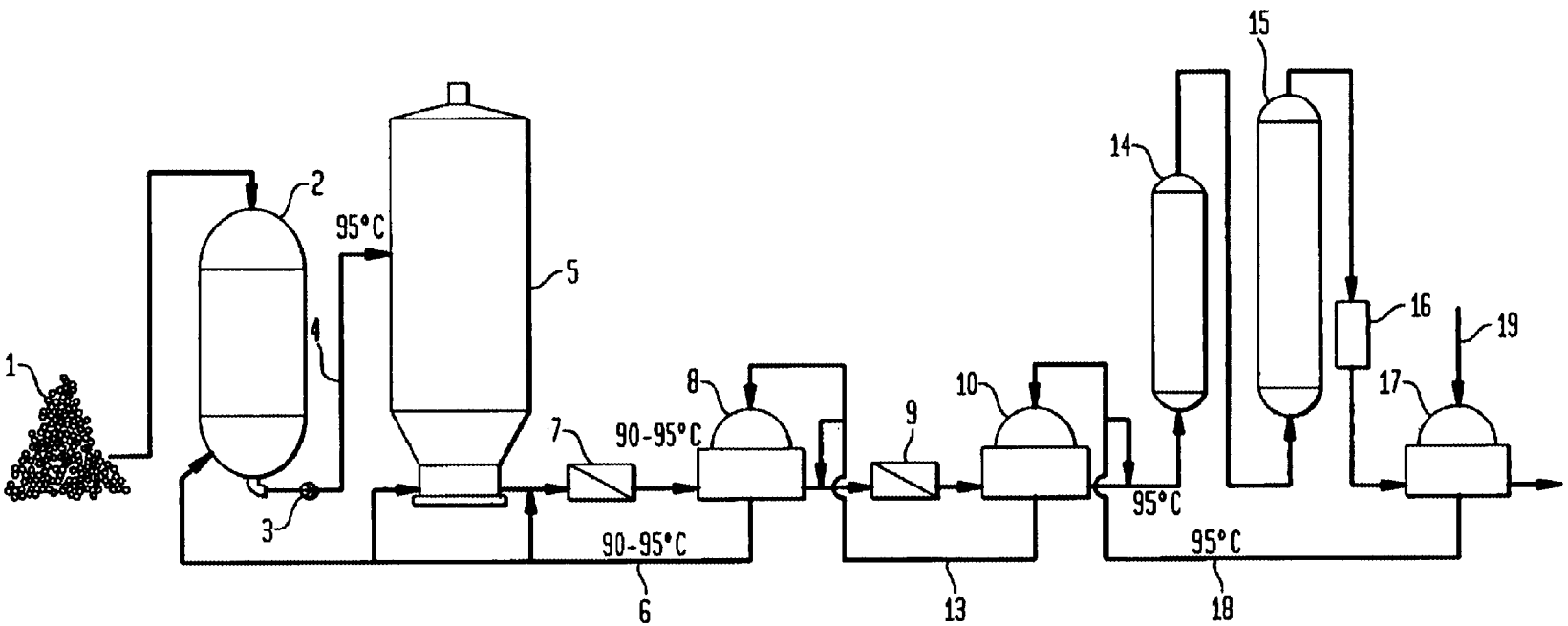
FIG. 2 (PRIOR ART)
FIG. 2 shows a prior art brownstock production line including two-step oxygen delignification.

Further, the brownstock line may be followed by e.g. a two-step oxygen delignification stage as shown in FIG. 2. The system features first and second oxygen delignification reactors (14, 15), as well as post-oxygen washer units 17. Wash water feed enters at (19), and is conveyed to previous countercurrent washing stages by line (18).

Figure 3:
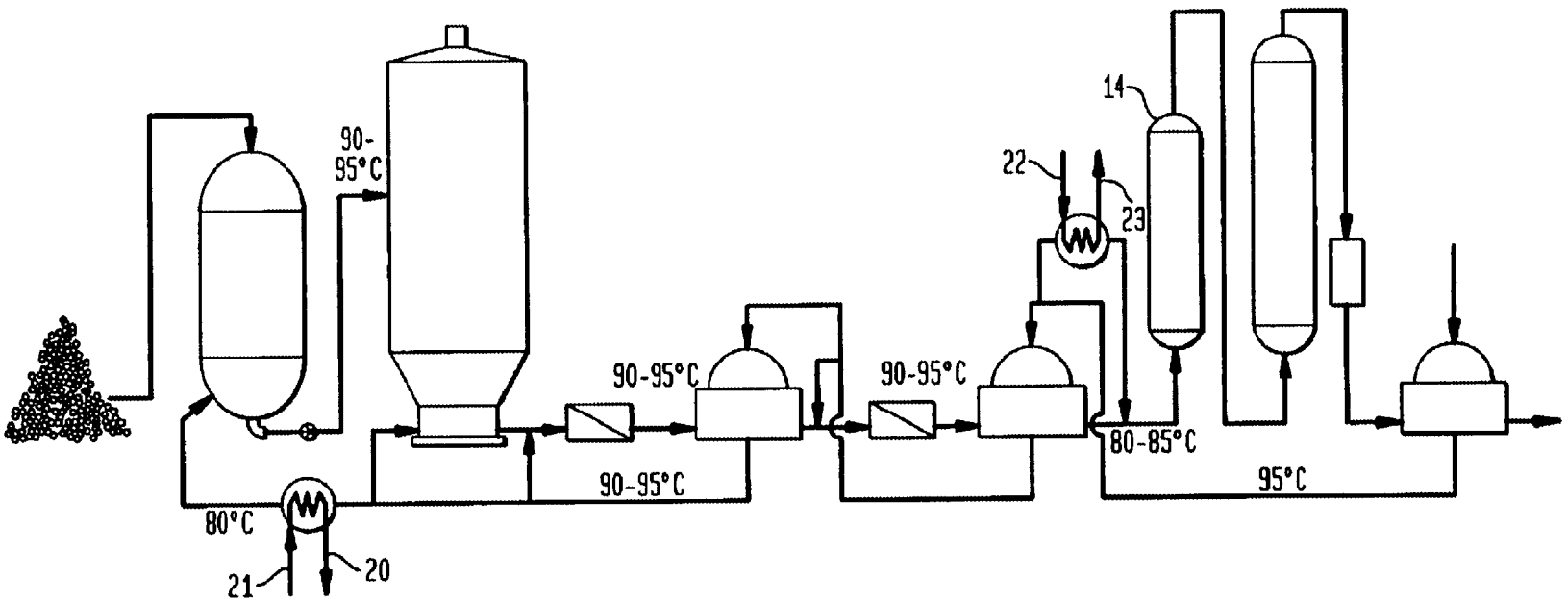
FIG. 3 shows a brownstock production line including two-step oxygen delignification and cooling of the wash liquor used for digester displacement.

As shown in FIG. 3, cooling by means of heat exchangers may be introduced into the system of FIG. 2 at points 20 and 22, using relatively cool water 21 and 23. A cooler dilution liquor from the last washing stage before the first delignification stage may be introduced in the pulp dilution stream to achieve desired temperature and consistency in the first reactor unit 14. Cooling at point 20 is used to more easily achieve the target discharge temperature 90–95° C., i.e. using less liquor and/or faster displacement.

Figure 4:
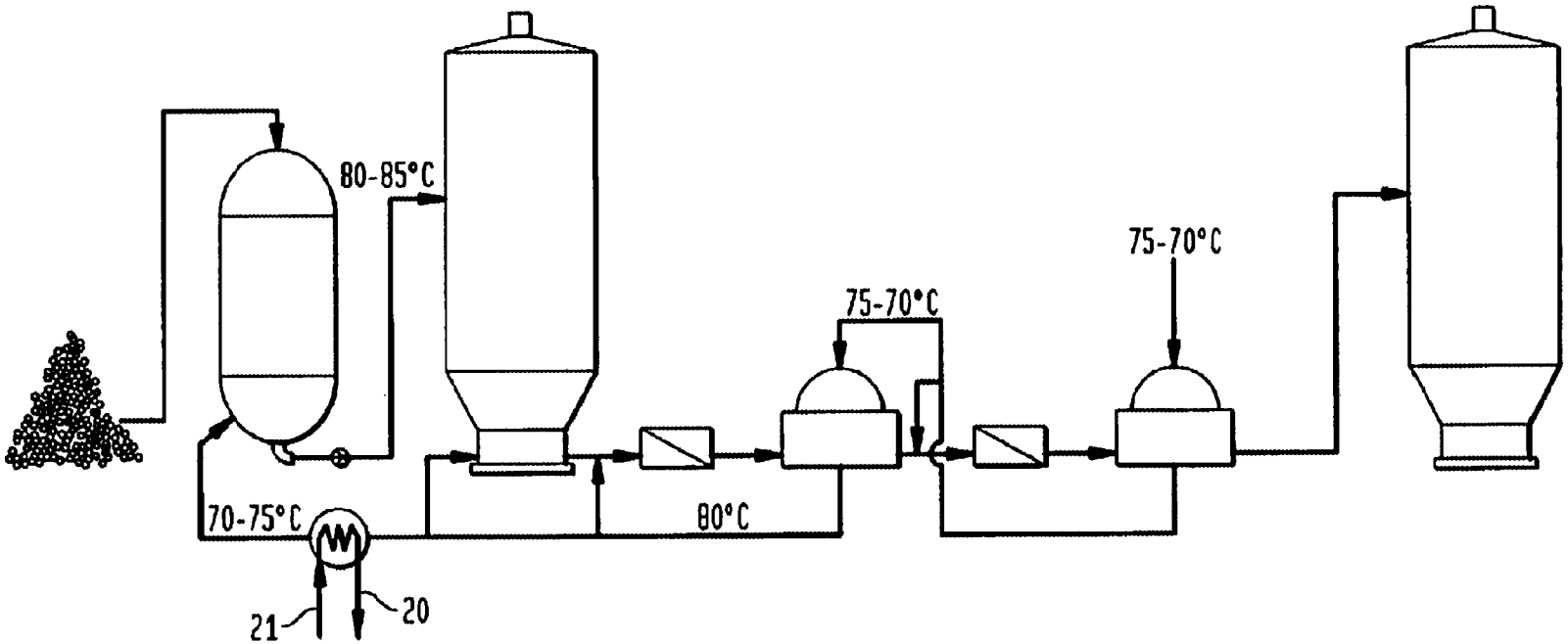
FIG. 4 shows a system according to the invention, wherein arrangements for lower temperatures are provided in the system of FIG. 1.

In a system according to the invention as shown in FIG. 4, wash water enters the countercurrent wash stream at a temperature about 70–75° C. Its temperature rises as it exchanges heat with the countercurrent product stream. Cooling is provided at (20) before the wash filtrate enters the digester at the end of a cook, providing displacement liquor having a temperature of between about 60 and about 80° C., preferably between about 70 to about 75° C. Additionally, displacement time and flow are adjusted so, that the most efficient cooling is achieved. Preferably, a flow of between about 10 and about 50 $dm^3$/min per $m^3$ digester volume is used. More preferably, a flow of between about 10 and about 35 $dm^3$/min per $m^3$ digester volume is used.

Figure 5:
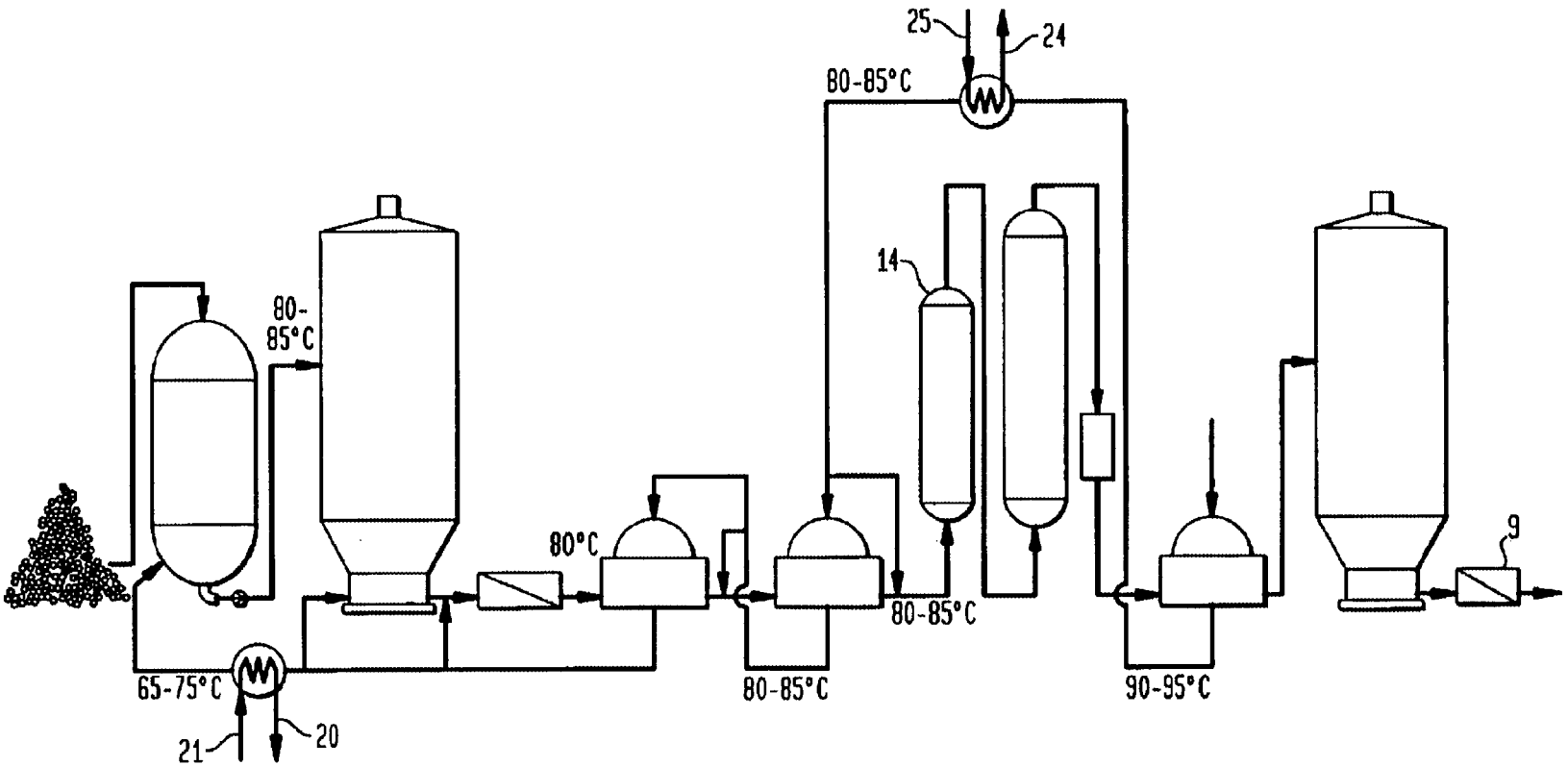
FIG. 5 shows a system according to the invention, wherein arrangements for lower temperatures are provided in the system of FIG. 3.

In a system according to the invention as shown in FIG. 5, cooling of wash filtrate is introduced at point (25) between the post- and pre-oxygen delignification washers. Thus, the stream entering oxygen delignification holds a temperature of between about 80 and about 85° C. Further, cooling of wash filtrate following the first brownstock washing unit is used to achieve the desired cooling efficiency. The cooked pulp thus leaves the digester at about 80° C. and holds a temperature not exceeding 85° C. throughout the stages between digester and oxygen delignification. Oxygen delignfication is carried out at 80–85° C. in the first reactor and 100° C. in the second reactor. Screening (9) has also been placed at a position where the ionic strength is typically below 0.4 mol/l and pH is typically below 11.

EXAMPLE 1

In an industrial liquor displacement batch digester plant, softwood chips (*Pinus sylvestris* and *Picea abies*) were cooked to kappa 23 and discharged. The temperature of the pulp from digester discharge to the first subsequent delignification stage was at the level at which liquor-displacement batch digesters are normally discharged, i.e., at temperature 90–95° C.

The pilot plant pulps were found to be stronger than the mill pulps. It was found that the mill batch pulp sampled from knotter feed showed 94% of the fiber strength of pilot-plant pulp. Further, the mill batch pulp sampled from the second washer showed only 88% of the fiber strength of pilot-plant pulp. Clearly, the mill-made batch pulp delivered to the first delignification stage after washing was weaker than the reference pilot-plant pulps made from the mill's chips.

EXAMPLE 2

In the same industrial displacement batch digester plant as in Example 1, softwood chips (*Pinus sylvestris* and *Picea abies*) were cooked to kappa 22 in the same manner as in Example 1, with the following exception: The digester discharge was carried out at a significantly lower temperature by increasing the cooling efficiency of the displacement by lowering displacement flow, increasing displacement times and using only cooled displacement black liquor in displacement. The applied changes did not affect production rate of the plant.

The mill pulps were found to have almost the same strength as the pilot-plant after cooking, digester discharge and storage of the cooked material in the discharge tank. The mill batch pulp sampled from knotter feed showed 100% of the fiber strength of pilot-plant pulp when digester discharge and pulp storage in the discharge tank were carried out below 85° C. The temperature of the second washer filtrate was 88° C. The mill batch pulp sampled from the second washer showed 93% of the fiber strength of pilot-plant pulp. Thus, the mill-made batch pulp delivered to the first oxygen delignification stage after washing was in this example also weaker than the reference pilot-plant pulps made from the mill's chips. However, the strength was significantly improved compared to example 1.

EXAMPLE 3

In a third series of experiments, in other respects analogous to Example 1 and 2, the temperature during stages following digester discharge was lowered further by use of lower temperature wash filtrate, the temperature of the second washer filtrate being 73° C. The mill pulps were found to have almost the same strength as the pilot-plant. It was found that the mill batch pulp sampled from the second washer showed 99% of the fiber strength of pilot-plant pulp when digester discharge and pulp storage in the tank and washing were carried out below 85° C. Thus, the mill-made batch pulp delivered to the first delignification stage after cooking, pulp storage, screening and washing showed in this example about the same strength as the reference pilot-plant pulps made from the mill's chips.

Table 1 shows the accumulated results from Examples 1–3. The Pulmac FS value is measured with a Pulmac 3000 equipment using the analysis principle of rewetted zero-span. Rewetting is used to essentially remove the bonding forces between the fibers. Rewetted zero-span (Pulmac FS) is used to describe the strength of individual fibers.

TABLE 1

Results from liquor-displacement batch cooking followed by digester pump discharge and tank storage, washing and screening compared to unblown pilot-plant reference cooks using the same chip raw material

| | Example 1 (Prior art process) | | | Example 2 | | | Example 3 | | |
|---|---|---|---|---|---|---|---|---|---|
| | Pilot plant | Feed to knotter | Washer 2 | Pilot plant | Feed to knotter | Washer 2 | Pilot plant | Feed to knotter | Washer 2 |
| Means of discharging the digester | not blown | pump | pump | not blown | pump | pump | not blown | pump | pump |
| Temperature of cooked material at discharge, ° C. | 80 | 95–90 | 95–90 | 80 | 79 | 79 | 80 | 80 | 80 |
| Temperature of 1 washer filtrate, ° C. | nd | 89 | 89 | nd | 82 | 82 | nd | 78 | 78 |
| Temperature of 2 washer filtrate, ° C. | nd | 93 | 93 | nd | 88 | 88 | nd | 73 | 73 |
| Cooking kappa | 21 | 23 | 23 | 22 | 22 | 21 | 21 | 19 | 21 |
| Brownstock strength, Pulmac FS | nd | 109 | 99 | nd | 117 | 102 | nd | 117 | 113 |
| Lab DEDED bleaching: | | | | | | | | | |
| Brightness | 88 | 87 | 88 | 88 | 88 | 88 | 88 | nd | 87 |
| Viscosity | 990 | 960 | 970 | 1000 | 950 | 950 | 972 | nd | 963 |
| Fiber strength following laboratory bleaching: | | | | | | | | | |
| Pulmac FS | 107 | 101 | 94 | 106 | 106 | 99 | 105 | nd | 104 |
| Percentage of pilot-plant | 100 | 94 | 88 | 100 | 100 | 93 | 100 | nd | 99 |

EXAMPLE 4

Mechanical treatment of cooked softwood kraft pulp at various temperatures

Figure 6:
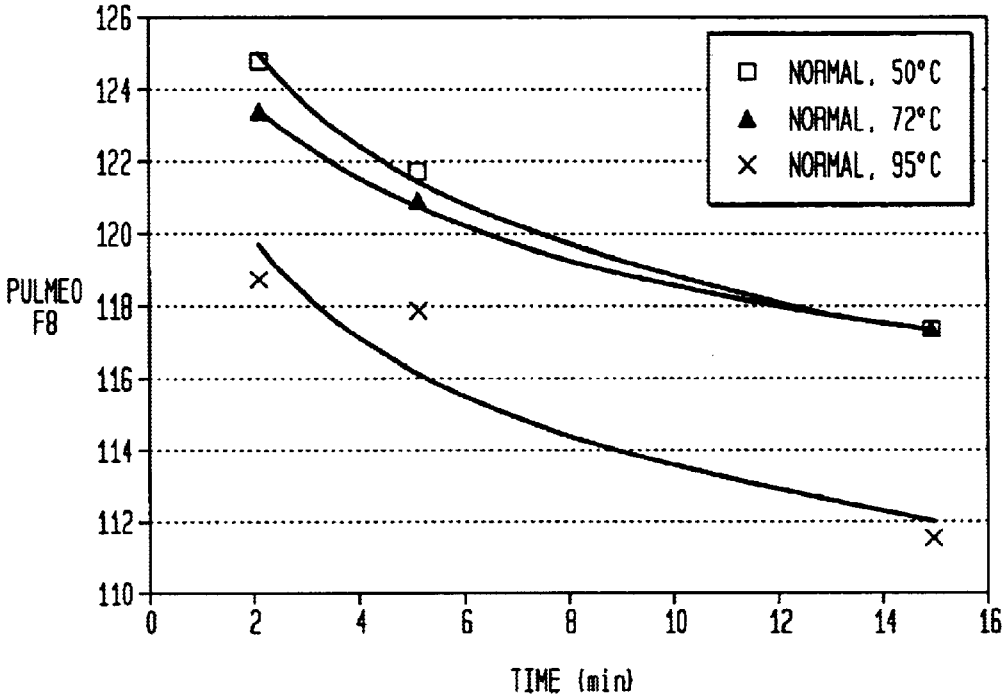
FIG. 6 shows pulp strength for three portions of cooked softwood chips disintegrated at different temperatures.

Cooking was carried out in a laboratory liquor displacement kraft batch digester using softwood chips (*Pinus sylvestris* and *Picea abies*). 4 kg of chips and mill black and white liquors were used in cooking. Cooking was carried out using black liquor impregnation (10 g (EA) NaOH/l, 80° C.) and hot black liquor treatment (28 g (EA) NaOH/l, 160° C.) prior to cooking with white liquor (sulfidity 38–40%) to kappa 22. The target H-factor was 1150 and end-of-cook residual EA was 19 g NaOH/l. After cooking to the required H-factor, the digester was displaced with mill wash liquor (7 g (EA) NaOH/l, 80 C.). After displacement, the digester content was circulated for 1 hour in the digester. After circulation, the digester was drained to a bucket without cooling, whereafter the warm, cooked chips were discharged into the same bucket. Subsequently, the cooked chips were mixed together with the liquor in the bucket in order to ensure uniform samples. The lot of cooked chips was divided into three parts. The same wash liquor as used in the cooks was preheated and used in dilution and tuning of pulp consistency to 3.2%. The three portions of cooked chips were then wet disintegrated using a rod pulp disintegrator. Temperatures of 95, 70 and 50° C., respectively, were used. Samples were taken at disintegration times of 2, 5 and 15 minutes. Pulp strength for the samples was determined by Pulmac FS. The analysis results for the three pulps disintegrated at different temperatures are given in FIG. 6. It is clearly seen that the resulting pulp strength after disintegration at 72° C. is significantly higher than after disintegration at 95° C., but a corresponding advantage is not achieved by further lowering the temperature. It is also seen that higher degree of mechanical treatment results in weaker fiber.

EXAMPLE 5

Mechanical treatment of softwood kraft pulp in various chemical environments

Cooking was carried out according to a displacement kraft batch process in a laboratory digester using softwood chips (*Pinus sylvestris* and *Picea abies*). 4 kg of chips and mill black and white liquors were used in cooking. Cooking was carried out using black liquor impregnation (9 g (EA) NaOH/l, 80° C.) and hot black liquor treatment (28 g (EA) NaOH/l, 160 C) prior to cooking with white liquor (sulfidity 38–40%) to kappa 19. The target H-factor was 1150, and end-of-cook residual EA was 20 g NaOH/l. After cooking to the required H-factor, the digester contents were displaced with various wash liquors, including pure water, at 80° C. After completed displacement, the digester content was circulated for 1 hour. After circulation, the digester was drained into a bucket without cooling, whereafter the warm cooked chips were discharged into the same bucket. Subsequently, the cooked chips were mixed together with the liquor in the bucket in order to ensure uniform samples. For each batch, the same wash liquor that was used for displacement was preheated and used in dilution and tuning of pulp consistency to 3%. The cooked chips were then wet disintegrated using a rod pulp disintegrator at a temperature of 70° C. during a disintegration time of 5 minutes. The analysis results are given in Table 5.

TABLE 5

Results from pulp disintegration after cooking in various environments.

| Wash liquor type | pH | EA, g NaOH/l | Na, g/l | D.S. % | Pulmac Fs |
|---|---|---|---|---|---|
| Mill 1 wash liquor 12 g (EA) NaOH/l | 13,3 | 12,6 | 32,2 | 12,8 | 112 |
| Mill 1 wash liquor 7 g (EA) NaOH/l | 13,1 | 6,5 | 29,5 | 13,0 | 113 |

TABLE 5-continued

Results from pulp disintegration after cooking in various environments.

| Wash liquor type | pH | EA, g NaOH/l | Na, g/l | D.S. % | Pulmac Fs |
|---|---|---|---|---|---|
| Mill 2 wash liquor 8 g (EA) NaOH/l | 13,1 | 7,4 | 22,4 | 9,3 | 113 |
| Buffer solution 2 g (EA) NaOH/l, 4 g ($Na_2S$) NaOH/l 5 g $Na_2CO_3$/l | 12,5 | 1,0 | 8,0 | 3,1 | 113 |
| Water | 11,1 | 0,0 | 1,2 | 0,8 | 121 |

Examples 4–5 demonstrate the importance of temperature and pH (alkali) in the treatment stages following cooking in the digester, i.e. digester discharge, pulp storage, pumping, screening and washing. The examples shows, that impure pulp having a high pH does not, even after gentle cooking, withstand vigorous mechanical treatment, and the higher the treatment temperature the more damage occurs. It also shows the importance of temperature at lower degrees of mechanical treatment. As shown by Example 4, a decrease in temperature clearly improved the fiber strength significantly. Example 5 shows that the fiber is more weakened the less pure (higher ionic strength of liquor in pulp) the pulp is during an alkaline mechanical treatment. In all industrial cooking systems, both batch and continuous, the impurity, ionic strength and alkali level are typically high after the cooking stage. Thus, the important parameters to control after cooking is the level of mechanical treatment (flow velocity, pressure drops), mixing intensity, temperature, as well as the chemical environment in terms of pH, alkali level and ionic strength.

What is claimed is:

1. A method for producing chemical pulp from lignocellulosic material by means of alkaline cooking, comprising:

cooking the material to pulp at a cooking temperature in a batch digester, to produce a cooked material;

essentially relieving overpressure by cooling the cooked material to a temperature between about 60° C. and about 85° C. using a wash liquor;

discharging the cooked and cooled material from the digester by means of pumping; and treating the pulp in equipment operating essentially at atmospheric or higher pressure, wherein the temperature of the cooked and cooled material is maintained during processing stages between the digester and a first substantial delignification/bleaching stage.

2. The method according of claim 1, wherein said cooling is carried out using the wash liquor comprising wash filtrate or water having a temperature from about 60° to about 80° C.

3. The method of claim 2, wherein the wash filtrate has an ionic strength below 1.5 mol/l.

4. The method of claim 2, wherein the wash filtrate has a pH between about 9 and about 13.

5. The method of claim 1, wherein said cooling is carried out using liquid displacement with an average flow of between about 10 and about 50 $dm^3$/min per $m^3$ digester volume.

6. The method of claim 5, wherein the digester volume is between about 10 and 35 $dm^3$/min per $m^3$.

7. The method of claim 1, wherein the wash liquor surrounding the cooked and cooled material during said processing stages between the digester and a first substantial delignification/bleaching stage has a pH above 11, and wherein said stages are carried out with a residence time less than about 180 minutes.

8. The method of claim 7, wherein the residence time is less than about 120 minutes.

9. The method of claim 1, wherein the wash liquor surrounding the cooked and cooled pulp during the processing stages between the digester and the first substantial delignification/bleaching stage is below about 13.

10. The method of claim 1, wherein the wash liquor surrounding the cooked and cooled pulp during the processing stages between the digester and the first substantial delignification/bleaching stage has an ionic strength essentially between 0.01 and 1.5 mol/l.

11. The method of claim 1, wherein the temperature of the cooked and cooled material is maintained during processing stages by means of heat exchangers (20,24).

12. The method of claim 1, wherein said first substantial delignification/bleaching stage is an oxygen delignification stage.

13. The method of claim 1, wherein said pumping is carried out using one or more variable speed pumps.

14. The method of claim 1, further comprising one or more screening stages carried out at an ionic strength below 0.4 mol/l.

* * * * *